US009119995B2

(12) United States Patent
Fischer

(10) Patent No.: US 9,119,995 B2
(45) Date of Patent: Sep. 1, 2015

(54) GOLF BALL TEEING DEVICE AND METHOD OF USE

(71) Applicant: Andrew J. Fischer, Littleton, CO (US)

(72) Inventor: Andrew J. Fischer, Littleton, CO (US)

( * ) Notice: Subject to any disclaimer, the term of this patent is extended or adjusted under 35 U.S.C. 154(b) by 0 days.

(21) Appl. No.: 14/143,621

(22) Filed: Dec. 30, 2013

(65) Prior Publication Data

US 2014/0357389 A1 Dec. 4, 2014

Related U.S. Application Data

(60) Provisional application No. 61/828,007, filed on May 28, 2013.

(51) Int. Cl.
*A63B 69/36* (2006.01)
*A63B 57/00* (2015.01)

(52) U.S. Cl.
CPC ..... *A63B 57/00* (2013.01); *A63B 57/0018* (2013.01); *A63B 69/3661* (2013.01); *A63B 69/3623* (2013.01); *A63B 2210/50* (2013.01)

(58) Field of Classification Search
CPC .. A63B 57/00; A63B 57/0006; A63B 47/002; A63B 69/3623; A63B 69/3661; A63B 57/0018; A63B 2210/50
USPC ..... 473/132–137
See application file for complete search history.

(56) References Cited

U.S. PATENT DOCUMENTS 2,216,853 A * 10/1940 Middleton ..... 473/137
4,995,614 A * 2/1991 Tange ..... 473/137
5,346,222 A * 9/1994 Luther, Sr. ..... 473/137
5,383,668 A 1/1995 Andrikian
5,458,339 A 10/1995 Wildes
5,464,223 A 11/1995 Dermott
5,549,518 A * 8/1996 Wang ..... 473/137
5,580,318 A * 12/1996 Weber ..... 473/137
5,599,237 A 2/1997 Fetterman et al.
5,603,664 A 2/1997 Provost
5,624,325 A * 4/1997 Smith ..... 473/137
5,632,687 A 5/1997 Bunyi
5,647,805 A 7/1997 Tarbox, Jr.
5,665,004 A 9/1997 Vlahovic
5,690,555 A * 11/1997 Lay ..... 473/137
5,704,844 A * 1/1998 Luther ..... 473/137
5,743,804 A 4/1998 Bacon
5,820,475 A * 10/1998 Luna ..... 473/137
5,895,325 A 4/1999 Tomey
6,106,405 A 8/2000 Fox
6,174,243 B1 * 1/2001 Choi ..... 473/137
6,315,676 B1 * 11/2001 Sandlin ..... 473/137
6,328,659 B1 * 12/2001 Peterson ..... 473/137
6,419,589 B1 * 7/2002 Carter ..... 473/134
6,572,485 B2 6/2003 Howard et al.
6,585,603 B2 7/2003 Montalvo
6,616,541 B2 9/2003 Michelizza (Continued)

*Primary Examiner* — Steven Wong
(74) *Attorney, Agent, or Firm* — Leyendecker Lemire, LLC

(57) ABSTRACT

A golf ball teeing device and methods of use are described. Embodiments of the golf ball teeing device include a swing arm rotatably coupled to a base. The base can be included to secure the swing arm to a golf mat or the ground. In a general operation, a golf ball can be moved to a cradle of the swing arm using a golf club. The golf club can then be used to engage and rotate the swing arm. As the swing arm is rotated, the golf ball can follow a track to an aperture. After the swing arm has rotated approximately 120 degrees, the golf ball can exit the aperture and deposit onto a tee. In some embodiments, a biasing structure can be included to return the swing arm to a starting position.

14 Claims, 8 Drawing Sheets

(56) References Cited

U.S. PATENT DOCUMENTS

| | | | | |
|---|---|---|---|---|
| 6,672,969 | B2 | 1/2004 | Lee | |
| 7,166,034 | B2 | 1/2007 | Hines et al. | |
| 7,775,897 | B2 | 8/2010 | Jones | |
| 7,871,332 | B2 | 1/2011 | Knez | |
| 8,409,023 | B1 | 4/2013 | Hogan | |
| 2003/0027654 | A1* | 2/2003 | Hong | 473/134 |
| 2008/0234061 | A1* | 9/2008 | Luna | 473/137 |
| 2010/0190563 | A1* | 7/2010 | Smith | 473/137 |

* cited by examiner

GOLF BALL TEEING DEVICE AND METHOD OF USE

CROSS-REFERENCE TO RELATED APPLICATION

This application claims the benefit of U.S. Provisional Application No. 61/828,007, filed 28 May 2013.

BACKGROUND

Golf is a popular sport requiring significant amounts of practice to create an easily repetitive swing. To create a repetitive swing, many golfers spend countless hours hitting golf balls at a driving range. One of the most commonly practiced shots by amateurs is the tee shot, where a player generally uses a metal wood and hits a ball off of a tee. When hitting off natural grass, the player will likely need to insert a new tee after each shot. Some stalls at golf ranges include rubber tees for use on artificial tee boxes.

Although the time required to put a ball on a tee may seem minute, over the course of a year the time can add up to valuable time lost not practicing. As such, the time and energy required to set a ball on a tee reduces the number of balls a golfer can hit in a given period of time. Further, tee shots require the player to continuously bend over and place the ball on the tee. In addition to strain created by repetitively striking a golf ball, bending over and teeing golf balls creates stress and strain on the body.

A less strenuous method of teeing a golf ball is needed to reduce stress and strain on a body of a golfer.

DETAILED DESCRIPTION

Figure 1:
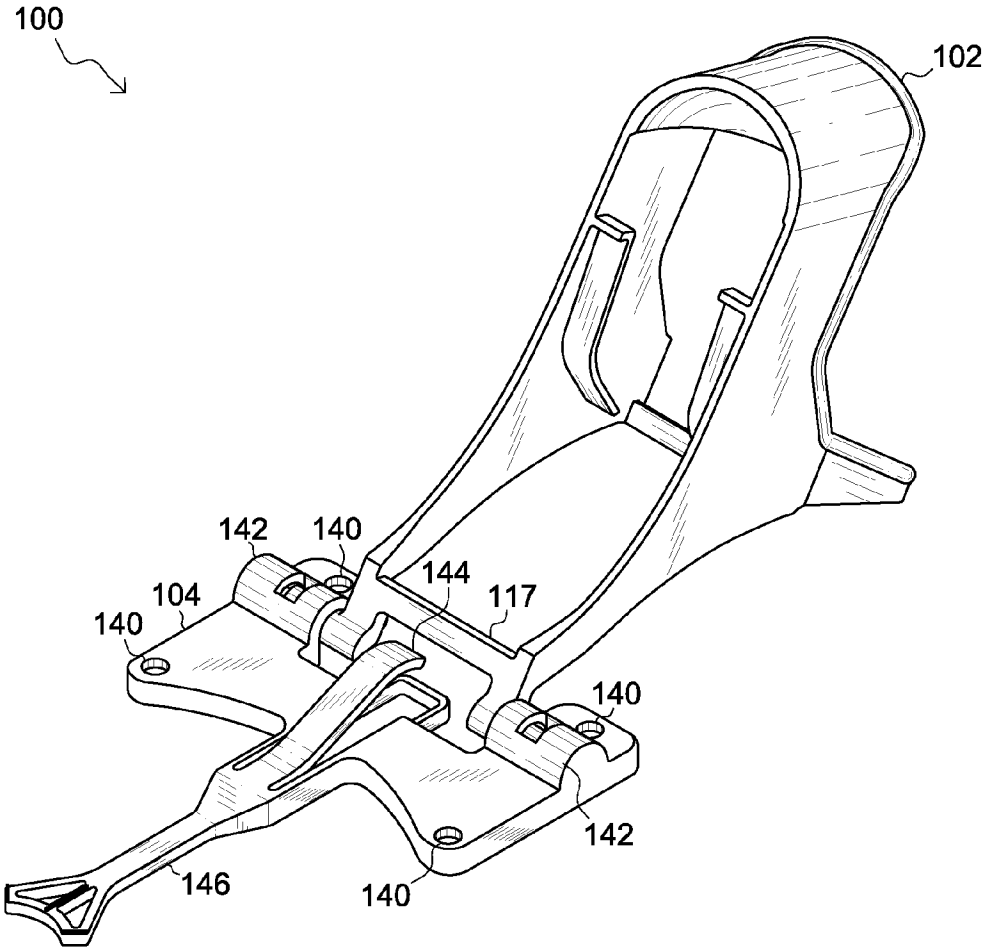
FIG. 1 is a perspective view of a teeing device according to one embodiment of the present invention.

Embodiments of the present invention include a golf ball teeing device adapted to place a golf ball on a tee. The teeing device can be implemented so that a golfer can place a golf ball on a tee using his/her golf club without bending over. Generally, the teeing device can be actuated by a golf club interfacing with the teeing device. In some embodiments, the teeing device can include a tee. For instance, the teeing device can include a removable rubber tee for use when practicing. In some embodiments, the teeing device can be implemented at a driving range. For instance, the teeing device can be adapted to couple to a range mat proximate a rubber tee of the range mat.

Generally, the teeing device can include a swing arm rotatably coupled to a base. The swing arm can include a pair of flanges, a ramp, a track, an aperture, and a cradle formed between the ramp and track. The swing arm can be adapted to receive and deposit a golf ball on a tee. The base can generally include one or more holes, a biasing structure, and a protrusion. Depending on an implementation, the base can be adapted to secure to the ground or a golf mat.

In a typical implementation, the teeing device can be secured to the ground via the base. A golf club can be used to roll a golf ball towards the swing arm. When the ball interfaces with the swing arm, the ball can be moved to the cradle. The ball can be held in the cradle until the swing arm is rotated. Generally, the swing arm can be contoured to interface with a golf club. As the swing arm is rotated by the golf club, the ball can move from the cradle and roll down the track to the aperture. The swing arm can rotate such that the aperture ends up directly above a tee. The ball can pass through the aperture and be deposited onto the tee. In some embodiments, the teeing device can include the biasing structure to return the swing arm back to an original position. After the teeing device moves out of the way, the golf ball can be hit off the tee.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

The term "golf mat," as used in this specification and the appended claims, refers to a piece of artificial grass or turf, used specifically for practicing golf shots.

The term "golf club," as used in the specification and the appended claims, refers to all types of golf clubs including, but not limited to, metal woods, irons, and putters.

A First Embodiment of a Golf Ball Teeing Device

Referring to FIG. 1, a detailed diagram of an embodiment 100 showing a golf ball teeing device is illustrated. The teeing device 100 can be implemented to place a golf ball on a golf tee. In one embodiment, the teeing device 100 can be actuated using a golf club. Referring to FIGS. 2A-2D, detailed diagrams of a swing arm 102 of the teeing device 100 are illustrated. FIGS. 3A-3C show one embodiment of a process 300 for implementing the teeing device 100.

As shown in FIG. 1, the teeing device 100 generally includes a swing arm 102 and a base 104. In some embodiments, the teeing device 100 can include a tee 105, as shown in FIGS. 3A-3C. For instance, the tee 105 can be a standard wooden golf tee, a plastic tee, or a rubber tee. It is to be appreciated that one of a plurality of types of golf tees can be implemented with the teeing device 100.

Figure 2B:
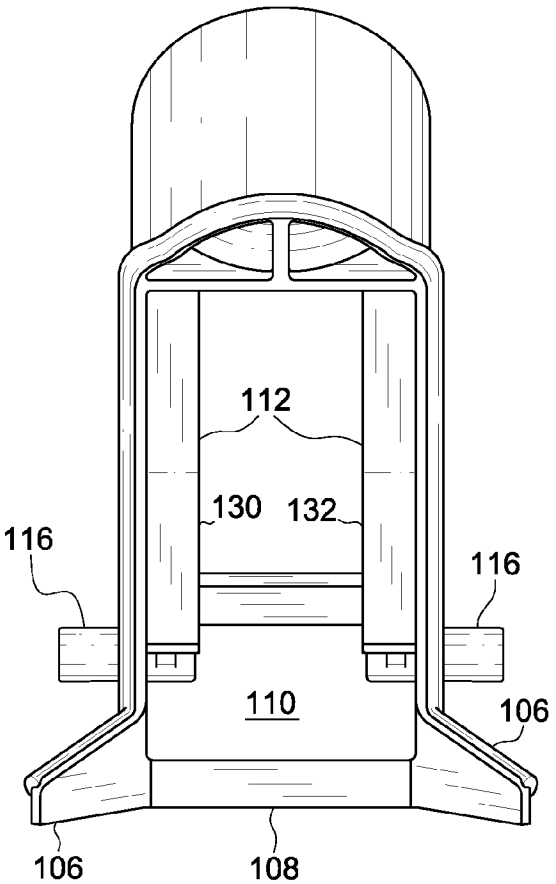
FIG. 2B is a front view of a swing arm according to one embodiment of the present invention.
Figure 2A:
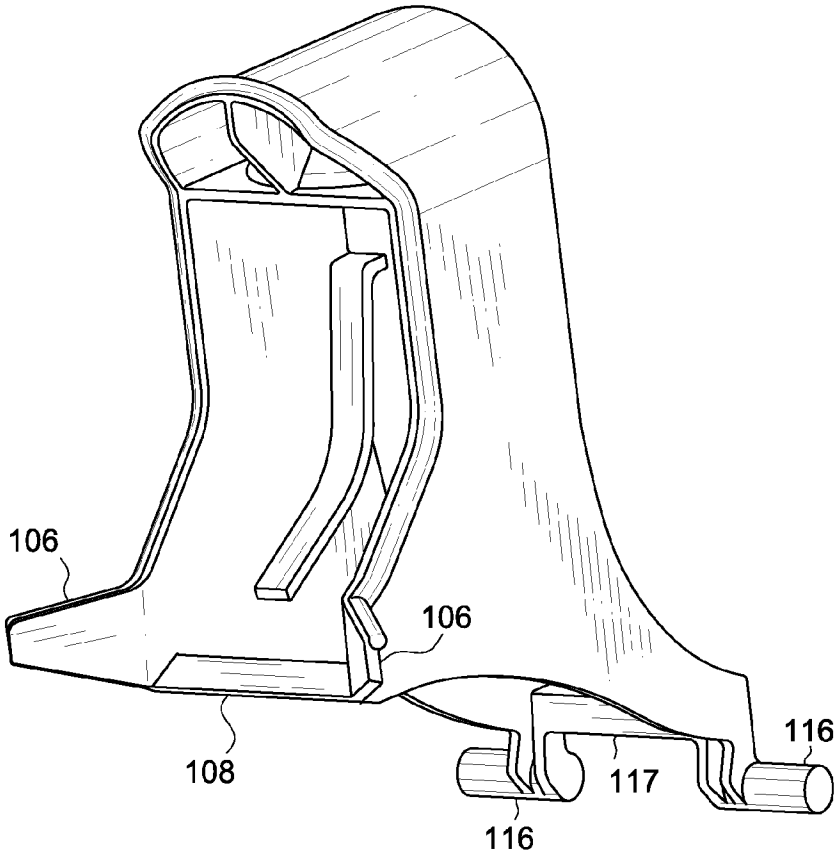
FIG. 2A is a front perspective view of a swing arm according to one embodiment of the present invention.
Figure 2D:
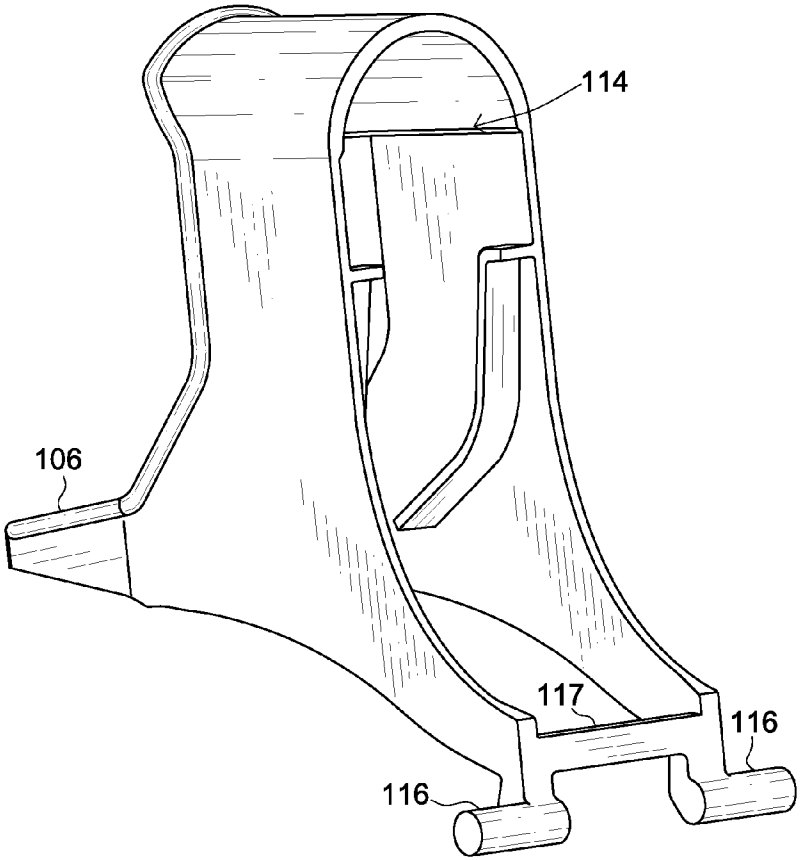
FIG. 2D is a back perspective view of a swing arm according to one embodiment of the present invention.

As shown generally in FIGS. 2A-2D, the swing arm 102 can include a pair of flanges 106, a ramp 108, a cradle 110, a track 112, an aperture 114, and an attachment structure 116. Generally, the swing arm 102 can be adapted to interface with a golf club. For instance, the swing arm 102 can have generally concave face adapted to interface with a golf club, as shown in FIG. 2A. It is to be appreciated that a golf club can include, but is not limited to, a metal wood, an iron, and/or a putter.

The pair of flanges 106 can be angled to form a funnel towards the ramp 108, as shown in FIGS. 2A-2B. For instance, the pair of flanges 106 can form a mouth adapted to receive a golf ball. Generally, the pair of flanges 106 can be implemented to funnel golf balls toward the ramp 108.

The ramp 108 can be included to elevate a golf ball off of a surface to the cradle 110. It is to be appreciated that the surface can include, but is not limited to, a golf mat, grass, and other surfaces typically encountered while playing golf. In one embodiment, the ramp 108 can be angled at approximately 45 degrees relative to the surface when the swing arm 102 is placed on the surface. It is to be appreciated that the ramp 108 can have varying degrees of incline without deviating from a scope of the present invention.

The cradle 110 can generally be located between the ramp 108 and a proximal end of the track 112. As shown in FIG. 2B, the cradle 110 can be formed by an upper end of the ramp 108 and the proximal end of the track 112. When in the cradle 110, a golf ball can be elevated off the surface and held in place. When the swing arm 102 is rotated about the attachment structure 116, the golf ball can move from the cradle 110 and engage the track 112.

The track 112 can guide a golf ball from the cradle 110 to the aperture 114. As shown in FIG. 2B, the track 112 can be located above the ramp 108 such that a golf ball can rest in the cradle 110. As the swing arm 102 is rotated, as shown in FIGS. 3B-3C, the golf ball can move from the cradle 110 and roll down the track 112.

Figure 2C:
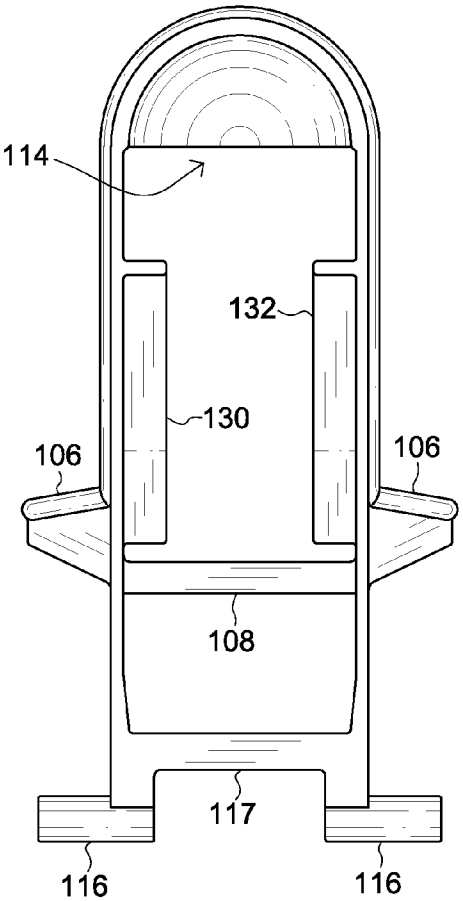
FIG. 2C is a back view of a swing arm according to one embodiment of the present invention.
Figure 3A:
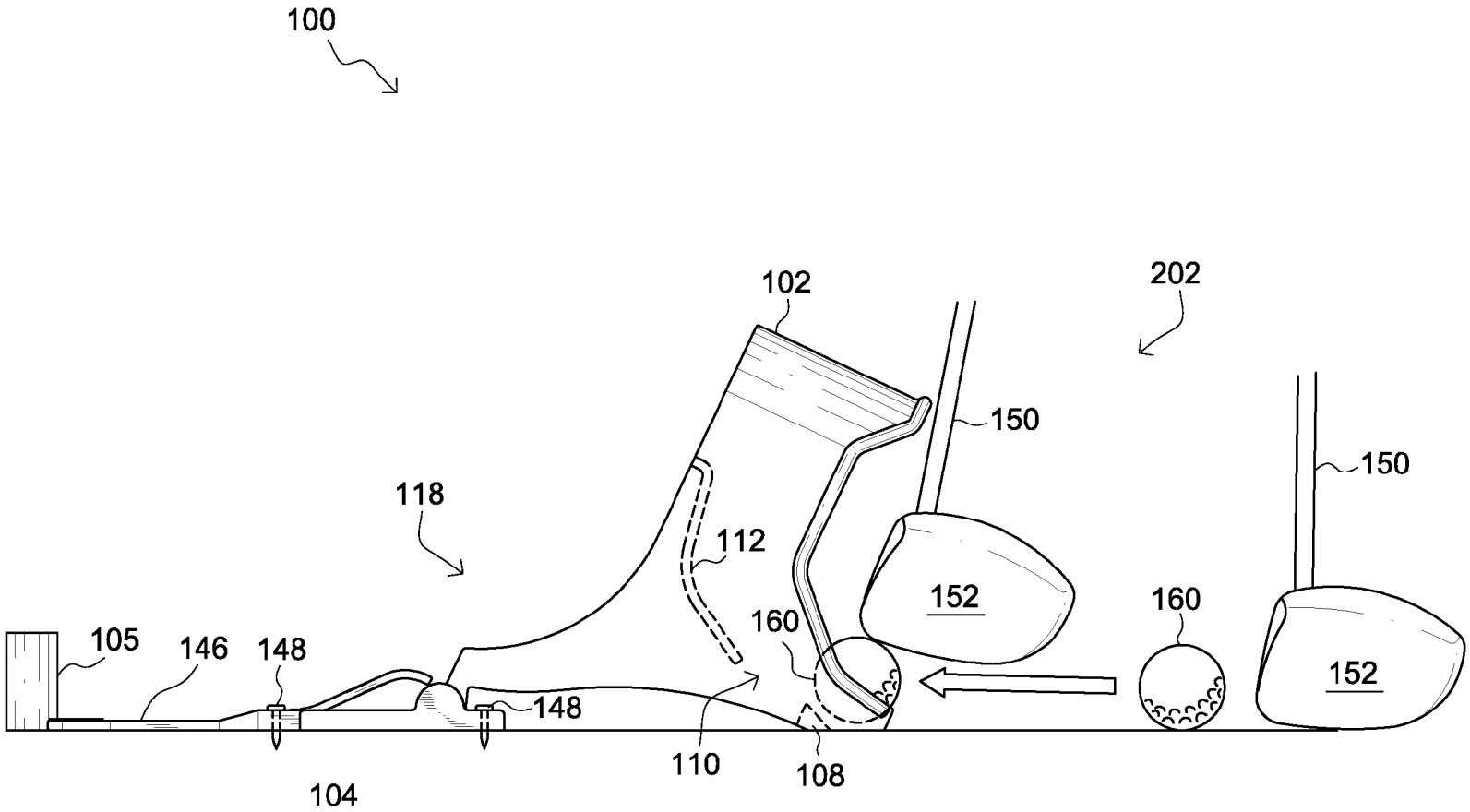
FIG. 3A is a side view of a first step of a teeing device teeing a golf ball according to one embodiment of the present invention.
Figure 3C:
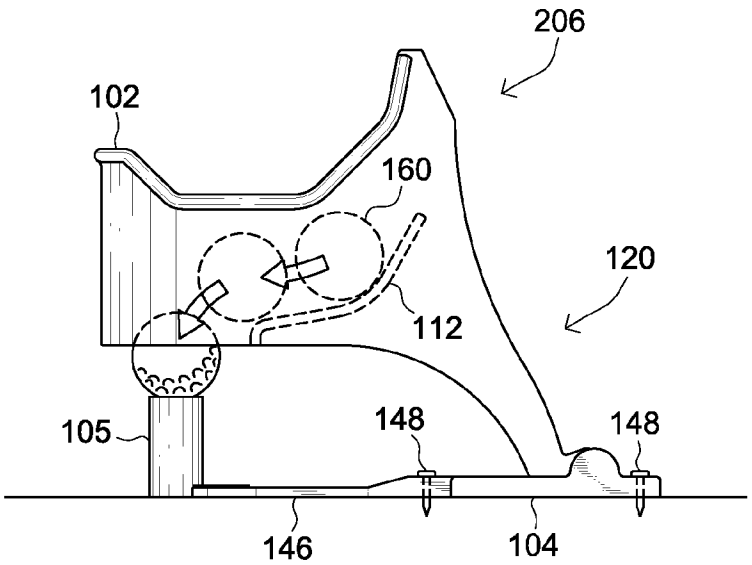
FIG. 3C is a side view of a third step of a teeing device teeing a golf ball according to one embodiment of the present invention.
Figure 3B:
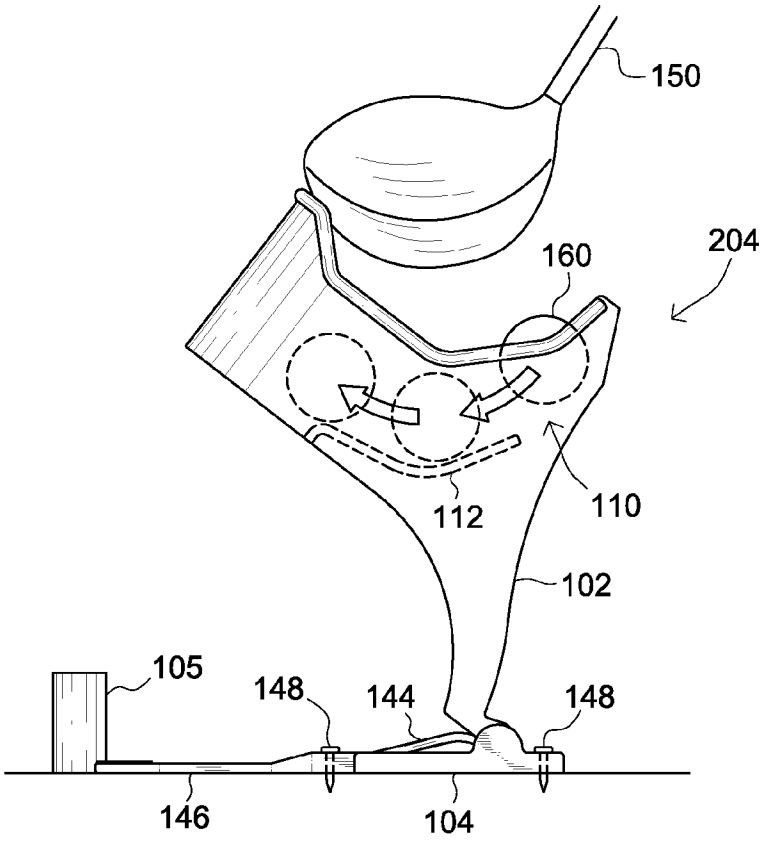
FIG. 3B is a side view of a second step of a teeing device teeing a golf ball according to one embodiment of the present invention.

In one embodiment, the track 112 can include a first rail 130 and a second rail 132, as shown in FIGS. 2B and 2C. Generally, a gap between the first rail 130 and the second rail 132 can have a width that can be slightly less than a diameter of a regulation golf ball. It is to be appreciated that other types of tracks can be implemented without exceeding a scope of the present invention. For instance, a single piece of material forming a slide can be implemented to form the track.

As the golf ball travels down the track 112, the golf ball can fall through the aperture 114 at a distal end of the track 112, as shown in FIG. 3C.

Generally, the aperture 114 and the tee 105 can be substantially concentric when the swing arm 102 is rotated approximately 120-130 degrees from a first position 118 to a second position 120, as shown in FIGS. 3A-3C and described in more detail hereinafter.

The attachment structure 116 can be adapted to couple the swing arm 102 to the base 104. As shown in FIGS. 2A-2D, the attachment structure 116 can include two pins orthogonally situated to the swing arm 102. Generally, the attachment structure 116 can rotatably couple the swing arm 102 to the base 104. For instance, a hinged connection can be implemented to secure the swing arm 102 to the base 104. It is to be appreciated that other structures and means can be implemented to rotatably couple the swing arm 102 to the base 104.

Referring back to FIG. 1, the base 104 can generally include one or more holes 140, an attachment structure 142, a biasing structure 144, and a protrusion 146.

The one or more holes 140 can be implemented to secure the base 104 to a surface. Generally, a securement structure 148 can be implemented to secure the base 104 to a surface, as shown in FIGS. 3A-3C. For instance, if the surface is grass, a tee can be inserted into each of the holes 140 to secure the base 104 to the ground. In another instance, a spike having a head with a diameter greater than the hole 140 can be inserted into the ground through each of the holes 140. In yet another instance, u-shaped pins can be inserted into each of the holes 140 to secure the base 104 to the ground. It is to be appreciated that a variety of securement structures can be implemented without exceeding a scope of the present invention.

The attachment structure 142 can be included to couple the base 104 to the swing arm 102. For instance, the attachment structure 142 can be adapted to receive pins of the swing arm attachment structure 116. It is to be appreciated that the base attachment structure 142 can be adapted to couple to the swing arm attachment structure 116. In one embodiment, the base attachment structure 142 can be removably and rotatably coupled to the swing arm attachment structure 116. For instance, a pair of hinge pins can be implemented to hingeably connect the swing arm 102 to the base 104. In one embodiment, the hinge pins can be molded into one of the swing arm 102 and the base 104 with the other having receiving holes for the hinge pins molded or otherwise formed into it.

The biasing structure 144 can be included to provide a restorative force to the swing arm 102. In embodiments including the biasing structure 144, the swing arm 102 can include an engagement bar 117, as shown generally in FIGS.

1-2D. The engagement bar 117 can be adapted to interface with the biasing structure 144. For instance, when the swing arm 102 is rotated, the biasing structure 144 can exert a force on the engagement bar 117. In another instance, the biasing structure 144 can apply a restorative biasing force to the engagement bar 117. In one embodiment, the biasing structure 144 can be manufactured from a resilient material.

In one embodiment, the biasing structure 144 can comprise a structure molded into the swing arm 102 or the base 104. For instance, an elongated generally planar tab adapted to brace against the engagement bar 117 and bend when the swing arm 102 is moved by a golf club, thereby applying a restorative biasing force. In another embodiment, the biasing structure 144 can be a spring integrated into the base attachment structure 142 and/or the swing arm attachment structure 106. For instance, a torsion spring can be implemented. In another instance, a torsion bar can be implemented. It is to be appreciated that other structures having properties similar to a spring can be implemented without deviating from a scope of the present invention. The biasing structure 144 can be provided to return the swing arm 102 to the first position 118 from the second position 120.

To properly place the tee 105 in relation to the teeing device 100, the protrusion 146 can be included with the base 104. A distal end of the protrusion 146 can be located approximate a center of the aperture 114 when the swing arm 102 is rotated approximately 120 degrees. For instance, the tee 105 can be placed approximate the distal end of the protrusion 146. Generally, the protrusion 146 can be implemented to determine a location of the tee 105.

Generally, the swing arm 102 and the base 104 can be made of a polymeric material, such as nylon, which may or may not include reinforcing fibers. For instance, reinforcing fibers can include, but is not limited to, fiberglass and carbon fiber. In one embodiment, the swing arm 102 and the base 104 can be injection molded and later joined together by a hinge assembly. In another embodiment, the swing arm 102 and the base 104 can comprise a single molded unit joined together with a living hinge. It is to be appreciated that the swing arm 102 and the base 104 can be made of other materials, such as aluminum, steel or other metal.

The design and construction of the base 104 and, more particularly, the tee 105 can be such that the base 104 and the tee 105 can withstand multiple and repeated high velocity hits by a head of a golf club without breaking. Although not shown, in some embodiments, one or more spikes can protrude from a bottom of the base 102 to help secure the teeing device 100 into the ground. The spikes can prevent the teeing device 100 from flying out off the ground and requiring retrieval and replacement by a golfer every time he/she accidentally hits the base 104 with a club. In one embodiment, the base 104 can have a flat bottom as the energy of a missed swing will be transferred to the base 104 and cause the teeing device 100 to go flying rather than increasing a probability that the tee 105 breaks.

A Method for Using the First Embodiment of a Golf Ball Teeing Device

Referring to FIGS. 3A-3C, detailed diagrams of the teeing device 100 being implemented at various steps of a method or process 200 are illustrated. FIGS. 3A-3C show the swing arm 102 rotating from the first position 118 to the second position 120. The first embodiment teeing device 100 can be implemented to tee a golf ball on a tee using a golf club.

In a first step 202, shown in FIG. 3A, a golfer can use a head 152 of a golf club 150 to drag, slide, or roll a golf ball 160 to the mouth 106 of the teeing device 100. As the golf ball enters the mouth 106 of the swing arm 102, the golf ball 160 can be moved to the cradle 110. The golf ball 160 can rest in the cradle 110 while the golfer moves the golf club head 152 to interact with the swing arm 102.

In a second step 204, after the golf ball 160 is in the cradle 110, the golfer can use the golf club head 152 to interact with the swing arm 102, as shown in FIGS. 3A and 3B. The golfer can use the golf club head 152 to rotate the swing arm 102 approximately 120 degrees from the first position 118 to the second position 120. As the swing arm 102 is rotated, the golf ball 160 can move from the cradle 110 to the tracks 112 of the swing arm 102, as shown in FIG. 3B.

In a third step 206, the golf ball 160 can go through the aperture 114 of the swing arm 102 and be deposited on the tee 105, as shown in FIG. 3C. In some embodiments, where the teeing device 100 includes a biasing mechanism, the swing arm 102 can rotate back to the first position 118 after the golf ball 160 has been deposited on the tee 105. In one embodiment, the golfer can manually rotate the swing arm 102 back to the first position 118.

A Second Embodiment of a Golf Ball Teeing Device

Figure 4:
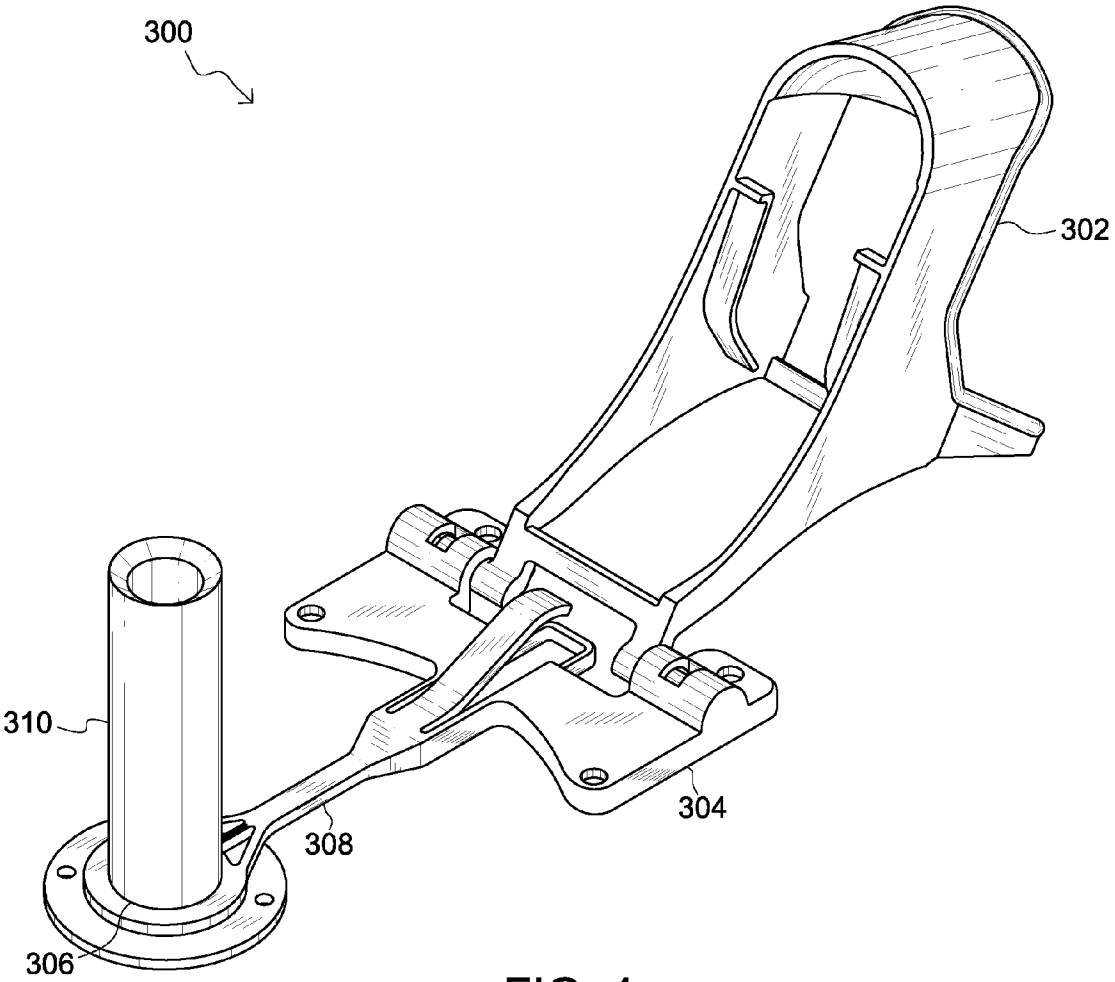
FIG. 4 is a perspective view of a teeing device according to one embodiment of the present invention.

Referring to FIG. 4, a detailed diagram of an embodiment 300 showing a golf ball teeing device is illustrated. The teeing device 300 can be implemented to place a golf ball on a practice golf tee.

The teeing device 300 can generally be similar to the first embodiment teeing device 100. The teeing device 300 can include a swing arm 302 and a base 304. The swing arm 302 can be substantially similar to the first embodiment swing arm 102.

The base 304 can be similar to the first embodiment base 104, but can include an aperture 306 at a distal end of a protrusion 308. The aperture 306 can be adapted to removably receive a tee 310. The aperture 306 can be sized to snuggly receive the tee 310. In one embodiment, the base 302 and the tee 310 can comprise separate and distinct elements wherein the tee 310 can be placed in aperture 306 provided at the distal end of the protrusion 308. In one embodiment, the base 304 can be comprised of a more rigid material while the tee 310 can be comprised of a more compliant material including, but not limited to, an elastomer that elastically deforms rather than breaks under impact. In one embodiment, the tee 310 can be replaceable should the tee 310 become damaged.

In one embodiment, the tee 310 can be a practice tee. For instance, the practice tee 310 can be a typical rubber tee found at driving ranges. In one embodiment, the practice tee 310 can be attached to the protrusion 308. For instance, the tee 310 can be a vertical extension of the protrusion 308.

A Third Embodiment of a Golf Ball Teeing Device

Figure 5:
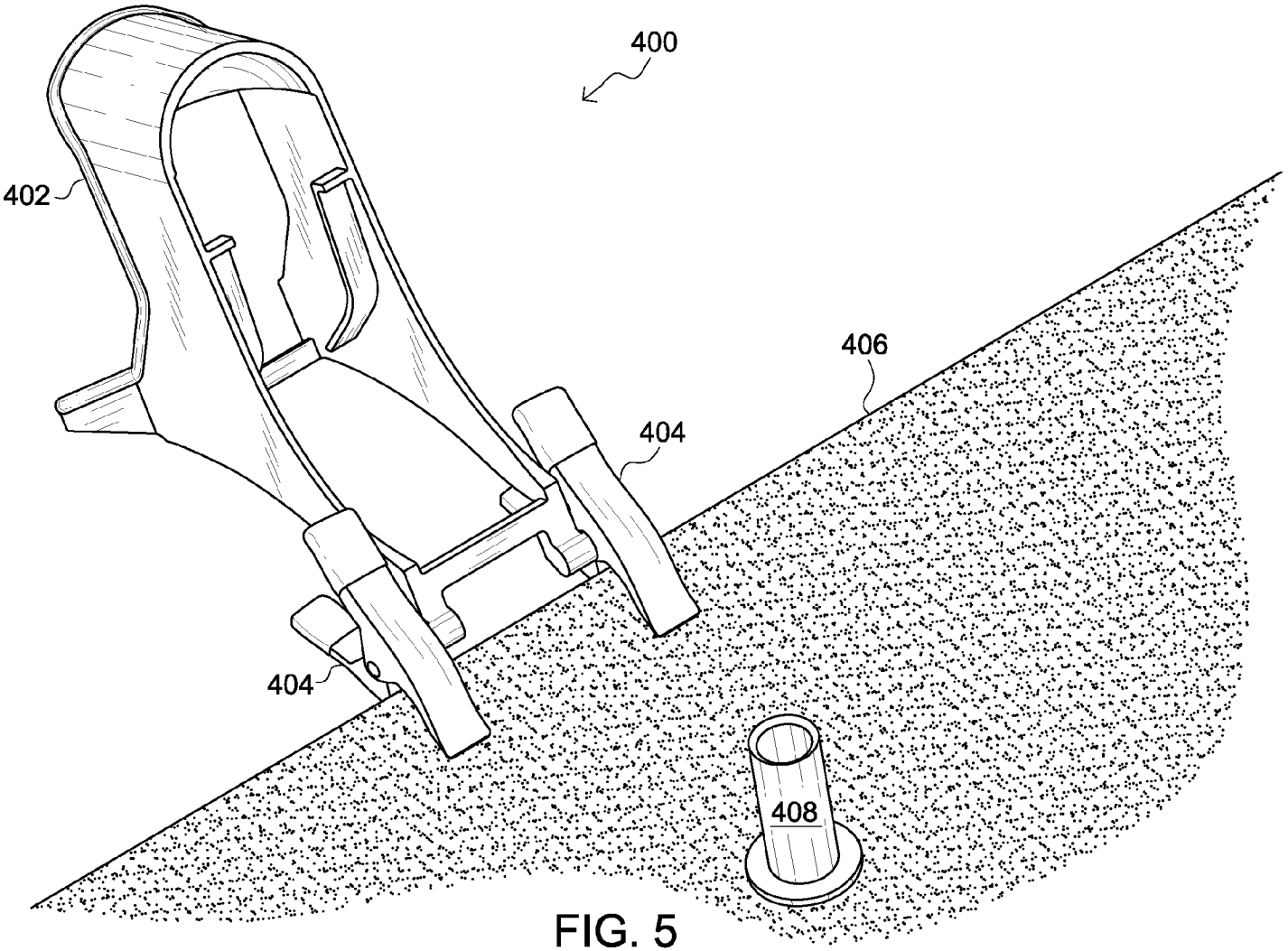
FIG. 5 is a perspective view of a teeing device interfacing with a golf mat according to one embodiment of the present invention.

Referring to FIG. 5, a detailed diagram of an embodiment 400 showing a golf ball teeing device is illustrated. The teeing device 400 can be implemented to attach to a practice golf mat. For instance, the teeing device 400 can be removably coupled to a practice mat at a driving range.

The teeing device 400 can include a swing arm 402 and an attachment structure 404. The swing arm 402 can be substantially similar to the first embodiment swing arm 102. Generally, the swing arm 402 can be rotatably coupled to the attachment structure 404. For instance, the swing arm 402 can have a hinged connection to the attachment structure 404. It is to be appreciated that any type of connection that rotatably couples the swing arm 402 to the attachment structure 404 can be implemented without exceeding a scope of the present invention.

The attachment structure 404 can be adapted to be removably coupled to a practice golf mat. For instance, the attachment structure 404 can include a pair of clamps. For example, the pair of clamps can be spring clamps. In another instance, the attachment structure 404 can include a piece of rigid material adapted to slide under the golf mat 406. The rigid piece of material can interface with a side of the golf mat 406 to prevent the attachment structure 404 from sliding completely under the golf mat 406. In yet another instance, the attachment structure 404 can have a u-shaped body adapted to interface with a side of the golf mat 406.

As shown in FIG. 5, the swing arm 402 can be coupled to the golf mat 406 proximate a practice tee 408. The teeing device 400 can be adapted to be used in conjunction with existing practice tees.

A Fourth Embodiment of a Golf Ball Teeing Device

Figure 6:
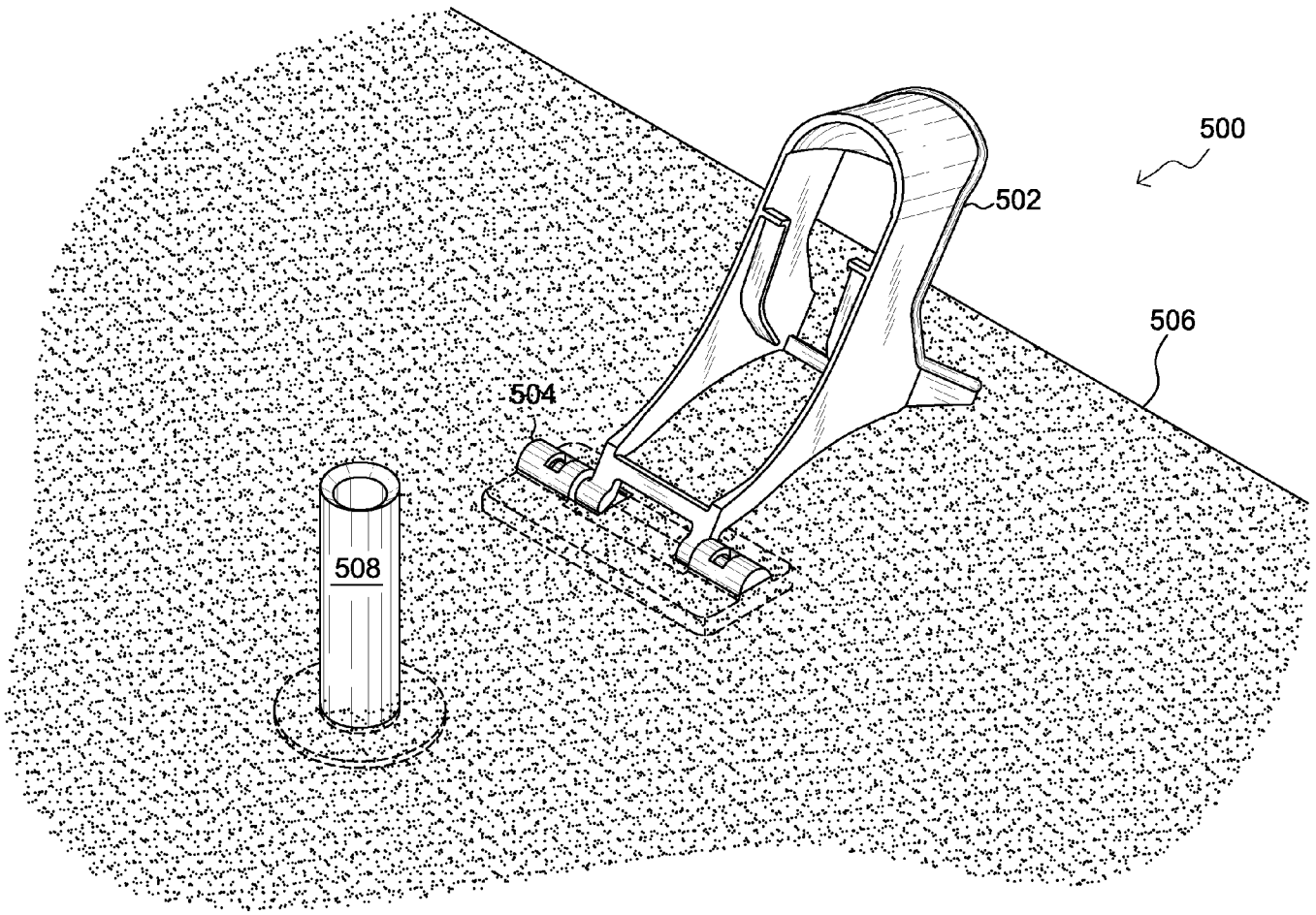
FIG. 6 is a perspective view of a teeing device integrated with a golf mat according to one embodiment of the present invention.

Referring to FIG. 6, a detailed diagram of an embodiment 500 showing a golf ball teeing device is illustrated. The teeing device 500 can be integrated with a practice golf mat. For instance, the teeing device 500 can be directly coupled to a practice mat.

The teeing device 500 can include a swing arm 502 and an attachment structure 504. The swing arm 502 can be substantially similar to the first embodiment swing arm 102. Typically, the swing arm 502 can be rotatably coupled to the attachment structure 504. In one embodiment, the swing arm 502 can have a hinged connection to the attachment structure 504. It is to be appreciated that any type of connection that rotatably couples the swing arm 502 to the attachment structure 504 can be implemented without exceeding a scope of the present invention.

Generally, the attachment structure 504 can be directly coupled to the practice golf mat 506. In one embodiment, the attachment structure 504 can be integrated into the golf mat 506, as shown in FIG. 6. As shown, the attachment structure 504 can have an attachment portion thereof on a top surface of the golf mat 504. The swing arm 502 can be rotatably attached to the attachment portion of the attachment structure 504.

In one embodiment, the attachment structure 504 can be adapted to receive pins of the swing arm 502. For instance, a pair of hinge pins can be implemented to hingeably connect the swing arm 502 to the attachment structure 504. In one embodiment, the hinge pins can be molded into one of the swing arm 502 and the attachment structure 504 with the other having receiving holes for the hinge pins molded or otherwise formed into it.

In one embodiment, although not shown, the attachment structure 504 can include a biasing structure. For instance, the biasing structure can be a spring integrated into the attachment structure 504 and/or the swing arm 502. For instance, a torsion spring can be implemented. The biasing structure can apply a restorative biasing force to the swing arm 502.

As shown in FIG. 6, the swing arm 502 can be coupled to the attachment structure 504 proximate a practice tee 508. The teeing device 500 can be adapted to be used in conjunction with existing practice tees.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A golf ball teeing device for use with a tee, the golf ball teeing device comprising:

a base including (i) one or more holes each adapted to receive a securement structure, (ii) a biasing structure, and (iii) a protrusion adapted to determine a location of a tee; and a swing arm rotatably coupled to the base, the swing arm including (i) a pair of flanges forming a mouth, (ii) an aperture through which the golf ball can pass, and (iii) a track adapted to guide the golf ball from the pair of flanges to the aperture;

wherein the swing arm rotates approximately 120-130 degrees from a first position to a second position;

wherein the mouth of the swing arm is proximate a playing surface in the first position and the aperture and the tee are substantially concentric when the swing arm is in the second position.

2. The golf ball teeing device of claim 1, further comprising:

the tee located proximate the protrusion.

3. The golf ball teeing device of claim 1, wherein the biasing structure provides a restorative force to the swing arm when the swing arm is in the second position.

4. The golf ball teeing device of claim 1, wherein the swing arm includes an engagement bar adapted to interface with the biasing structure.

5. The golf ball teeing device of claim 1, wherein the swing arm is contoured to interface with a golf club.

6. The golf ball teeing device of claim 1, wherein the protrusion removably engages a rubber tee.

7. A golf ball teeing device for a golf mat having a rubber tee, the golf ball teeing device comprising:

an attachment structure adapted to removably couple to the golf mat;

a swing arm rotatably coupled to the attachment structure, the swing arm including (i) a pair of flanges forming a mouth, (ii) an aperture through which a golf ball can pass, and (iii) a track adapted to guide the golf ball from the mouth to the aperture;

wherein the swing arm rotates approximately 120-130 degrees from a first position to a second position;

wherein the mouth of the swing arm is proximate a surface of the golf mat in the first position;

wherein when the swing arm is in the second position the aperture and the rubber tee are substantially concentric.

8. The golf ball teeing device of claim 7, wherein the attachment structure includes a pair of spring clamps.

9. The golf ball teeing device of claim 7, wherein the attachment structure couples the swing arm to the golf mat approximate the rubber tee.

10. The golf ball teeing device of claim 7, wherein the attachment structure includes a biasing structure.

11. The golf ball teeing device of claim 10, wherein the biasing structure provides a restorative force to the swing arm when the swing arm is in the second position.

12. The golf ball teeing device of claim 7, wherein the swing arm is contoured to interface with a golf club.

13. The golf ball teeing device of claim 7, wherein the swing arm is removably coupled to the attachment structure.

14. A golf ball teeing device for use with a tee, the golf ball teeing device comprising:

a pair of flanges forming a mouth;

an aperture through which a golf ball can exit; a track adapted to guide the golf ball from the mouth to the aperture; and an attachment structure adapted to removably and rotatably couple to a structure selected from the group consisting of a base and a mat attachment structure;

wherein the base includes (i) one or more holes each adapted to receive a securement structure, (ii) a biasing structure, and (iii) a protrusion;

wherein the mat attachment structure is adapted to removably couple to a golf mat; wherein the pair of flanges, the aperture, and the track are adapted to rotate approximately 120-130 degrees together from a first position to a second position;

wherein the mouth is proximate a playing surface when the pair of flanges, the aperture, and the track are in the first position;

wherein the aperture is substantially concentric to [a] the tee when the pair of flanges, the aperture, and the track are in the second position.

* * * * *